US007000523B2

(12) United States Patent
Mori et al.

(10) Patent No.: US 7,000,523 B2
(45) Date of Patent: Feb. 21, 2006

(54) BLADE HOLDER AND SUPPORT MEMBER FOR PERFORATOR

(75) Inventors: Makoto Mori, Katsushika-ku (JP); Hiroshi Tadenuma, Katsushika-ku (JP); Tokihiro Sakuma, Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 268 days.

(21) Appl. No.: 10/208,747

(22) Filed: Aug. 1, 2002

(65) Prior Publication Data

US 2003/0029292 A1 Feb. 13, 2003

(30) Foreign Application Priority Data

Aug. 9, 2001 (JP) ..... 2001-242153
Jul. 4, 2002 (JP) ..... 2002-195795

(51) Int. Cl.
*B26D 7/26* (2006.01)

(52) U.S. Cl. ..... 83/698.91
(58) Field of Classification Search ..... 83/698.91, 83/621

See application file for complete search history.

(56) References Cited

U.S. PATENT DOCUMENTS 5,038,599 A * 8/1991 Wellman ..... 72/482.91
5,054,347 A * 10/1991 Johnson et al. ..... 83/140
5,197,368 A * 3/1993 Meyer et al. ..... 83/698.31
5,943,934 A * 8/1999 Codatto ..... 83/684
6,536,321 B1 * 3/2003 Whiteman et al. ..... 83/698.31

FOREIGN PATENT DOCUMENTS

GB 2 306 374 A 5/1997
JP 59-183400 U 12/1984
JP 2000-233398 A 8/2000

* cited by examiner

*Primary Examiner*—Charles Goodman
(74) *Attorney, Agent, or Firm*—Oliff & Berridge, PLC

(57) ABSTRACT

A holder and a support member for mounting a blade to a perforator are provided. The holder is composed of a blade, a two-position switching member, and a mounting member. The holder is assembled detachably to the support member along the external shape of the mounting member by operating the two-position switching member. The two-position switching member has an elastic compression member between it and the mounting member to impart elasticity to the operation, and has also an engaging section to fit into a groove in the support member, thereby ensuring the engaged state of the holder. The support member 150 includes a groove for mounting the blade and a clearance groove for punch cuttings above the groove.

6 Claims, 16 Drawing Sheets

BLADE HOLDER AND SUPPORT MEMBER FOR PERFORATOR

BACKGROUND OF THE INVENTION

1. Field of the Invention

The present invention relates to a holder and a support member working in a pair therewith for mounting a blade to a perforator.

2. Description of the Related Art

Perforators (hole punches) for punching a plurality of holes in a sheet have various structures. In general, many perforators have a holder-type structure in which a blade for punching holes is not directly mounted to a perforator but is mounted to a support member or the like in the perforator using a mounting member or the like. Typically, the holder is configured such that the blade is not easily disengaged with operational safety in mind.

For example, in a perforator 1, shown in FIGS. 21 and 22, a blade 20 is mounted to a support member 15 (refer to FIGS. 22 and 23) in the perforator 1 using a holder having a mounting member 21 shown in FIG. 23. In this case, by rotating a handle 12 (refer to FIGS. 21 and 22) of the perforator 1 to move the support member 15 vertically, the blade 20 is moved vertically to perform punching operation. In the conventional art, in general, the blade 20 is attached to the mounting member 21 so as to face thereto from above to below, and also, the mounting member 21 having the blade 20 is secured to the support member 15 by mechanical coupling using a screw 23 and a screw hole 22 (refer to FIG. 23) and so on.

However, when replacing the blade 20 or when various punching operations are intended using various types of blades 20, it is preferable that the mounting member 21 be more quickly attached to the support member 15 in the perforator 1 than the screw-type mounting member.

The holder for assembling the blade 20 to the support member 15 in the perforator 1 using the mounting member 21, shown in FIG. 23, is disclosed, for example, in Japanese Unexamined Utility Model Registration Application Publication No. 59-183400 and so on. In this case, the holder is assembled such that the mounting member 21 is formed of an L-shaped metal fitting, the blade 20 is provided on the bottom of the L-shaped metal fitting, and the mounting member 21 is assembled to the support member 15 in front of the L-shaped metal fitting (refer to FIG. 23). Since the support member 15 is secured to the mounting member 21 in the front (refer to FIG. 23), the assembly characteristic is satisfactory, however, taking a trouble of attaching with a screw.

Another related art concerned is disclosed in Japanese Unexamined Patent Application Publication No. 2000-233398. This perforator includes a support member on a base, supported by an operation handle, and a mounting member is attached in a cavity formed in the support member, wherein the end of a blade inserted into the mounting member, which moves vertically, is positioned on a punching face of the base.

More specifically, the perforator has a coil spring in the mounting member for attaching the mounting member to the support member and pushing a protrusion above the coil spring such that it freely vertically moves. Therefore, when inserting the mounting member into the perforator, the coil spring is vertically moved to bring the protrusion into engagement with the support member, thereby mounting the mounting member to the perforator.

In this case, the support member is fixed to the mounting member on the bottom thereof, and the mounting member is configured to freely move vertically using the coil spring, and accordingly, the mounting member sometimes swings during the operation of the perforator.

SUMMARY OF THE INVENTION

The present invention has been made in view of the above problems. Accordingly, it is an object of the present invention to provide a holder for mounting a blade to a perforator, the holder being mounted quickly and detachably and being engaged not to swing during operation, and a support member working in a pair with the holder.

In order to achieve the above object, according to a first aspect of the present invention, there is provided a holder for mounting a blade to a perforator, comprising a blade and a mounting member including a two-position switching member, wherein the mounting member retains the blade and is mounted to the perforator through the two-position switching member.

With such a configuration, a holder for detachably and smoothly mounting the blade to the perforator using the two-position switching member can be provided.

According to the present invention, preferably, the holder is detachably mounted to the perforator along the external shape of the mounting member and is retained in its assembled position with the two-position switching member in the above invention.

With such a configuration, there is provided a holder that is detachably mounted to the perforator more smoothly as compared with a conventional screw-type coupling method and retains the blade in its assembled position such that it does not swing during operation.

According to the present invention, preferably, the mounting member and the two-position switching member have an elastic compression member sandwiched therebetween in the above invention.

With such a configuration, there is provided a holder for applying elasticity to mounting operation to stably perform mounting/demounting operations by sandwiching the elastic compression member between it and the mounting member in contact therewith.

According to the present invention, preferably, the elastic compression member has a retaining section for maintaining the two-position switching member in its operating position in the above invention.

With such a configuration, there is provided a holder that memorizes the operating position of the two-position switching member during mounting/demounting operations.

According to the present invention, preferably, the two-position switching member can freely be switched rotatably in the above invention.

With such a configuration, there is provided a holder that smoothly and easily selects an engaged state by rotating operation.

According to the present invention, preferably, the two-position switching member includes an engaging section for engaging with a groove in a support member in the perforator to bring the holder into engagement with the support member of the perforator in the above invention.

With such a configuration, there is provided a holder that brings the engaging section of the two-position switching member and the groove in the support member into engagement with each other, thereby being positioned stably in the support member without swinging during operation.

According to a second aspect of the present invention, there is provided a support member to which a holder having a blade is mounted, for accommodating the holder in a perforator, wherein the holder has the characteristics described above; the blade has a substantially cylindrical shape and releases punch cuttings upward therethrough; and the support member includes a first groove for positioning the blade and a second groove for releasing the punch cuttings above the first groove.

With such a configuration, a support member can be provided in which no punch cuttings are caught therein particularly during the mounting/demounting operations of the substantially cylindrical blade that releases the punch cuttings from below to above.

According to the second aspect of the present invention, the support member includes therein a groove in which the punch cuttings are collected, an opening formed in the groove for communicating with the interior of the blade, and a punch-cuttings drop prevention device for shielding the opening.

With such a configuration, the punch cuttings are collected into the groove in the support member from the interior of the blade during punching and, furthermore, the punch cuttings remaining in the groove in the support member are prevented from dropping through the opening when the holder is disengaged from the support member, thus the work environment is held in good condition.

While the holder and the support member according to the present invention are configured as described above, preferably, the mounting member includes the engaging section on its main body, for detachably mounting the holder to the support member of the perforator along the external shape of the mounting member. In the assembly operation, the holder may be assembled to the support member from the front or side. Also, while the holder according to the present invention has the engaging section on the two-position switching member to engage with the support member, preferably, the engaging section is tapered and a plurality of the tapered faces may be formed. The shape of the engaging section has only to have a function of bring the holder into engagement with the support member. At that time, the support member has a groove for engaging with the tapered face. Preferably, the groove has a stop face with which the tapered face is brought into contact for positioning. Furthermore, it is preferable that the two-position switching member has the elastic compression member therein, which is preferably a leaf spring. The elastic compression member may have a retaining section on the main body to memorize the operating position of the two-position switching member for engaging with the mounting member. The retaining section may be a protrusion or a concave cutoff portion. Also, the number and the shape of the engaging sections are arbitrarily selected.

DESCRIPTION OF THE PREFERRED EMBODIMENTS

Figure 1:
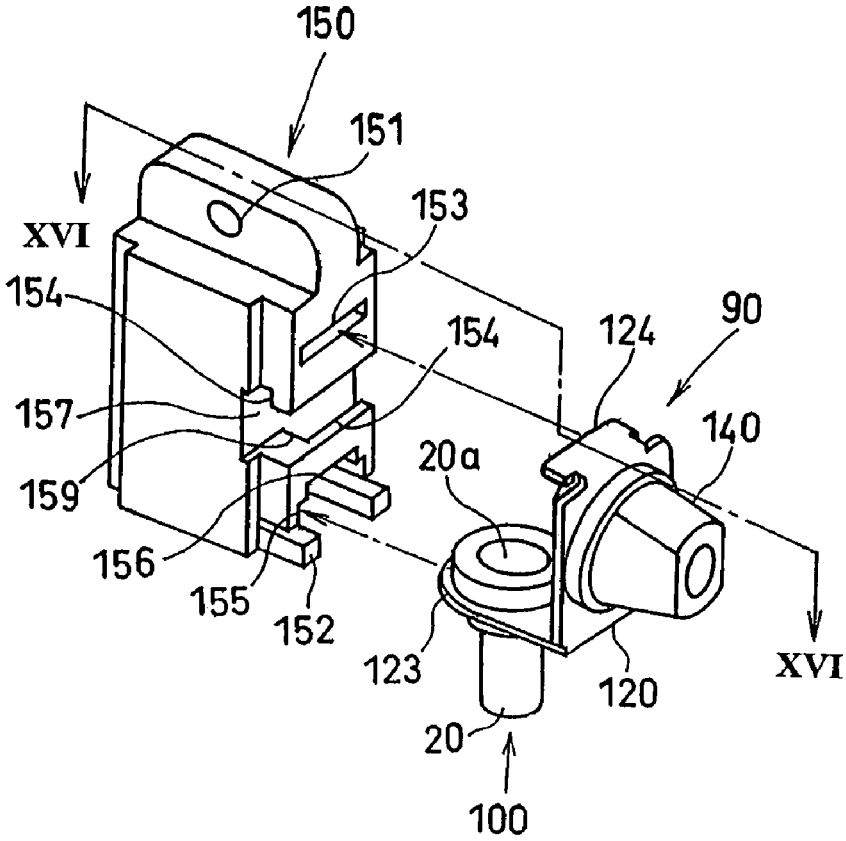
FIG. 1 is a perspective view of a holder and a support member according to a first embodiment of the present invention.

Preferred embodiments of the present invention will be described hereinbelow with reference to the drawings.

First, the overall configuration of a perforator 1 will be described with reference to FIGS. 21 and 22. However, it should be understood that the present invention is not limited in its application to the details of the perforator 1 shown in the drawings. For example, the perforator 1 is not limited to a two-hole-punch type, but may be a one-hole-punch type or, alternatively, a type of punching a larger number of holes. Referring to FIG. 23, a holder for a blade 20 and a support member 15 according to a conventional art will be discussed.

Figure 21:
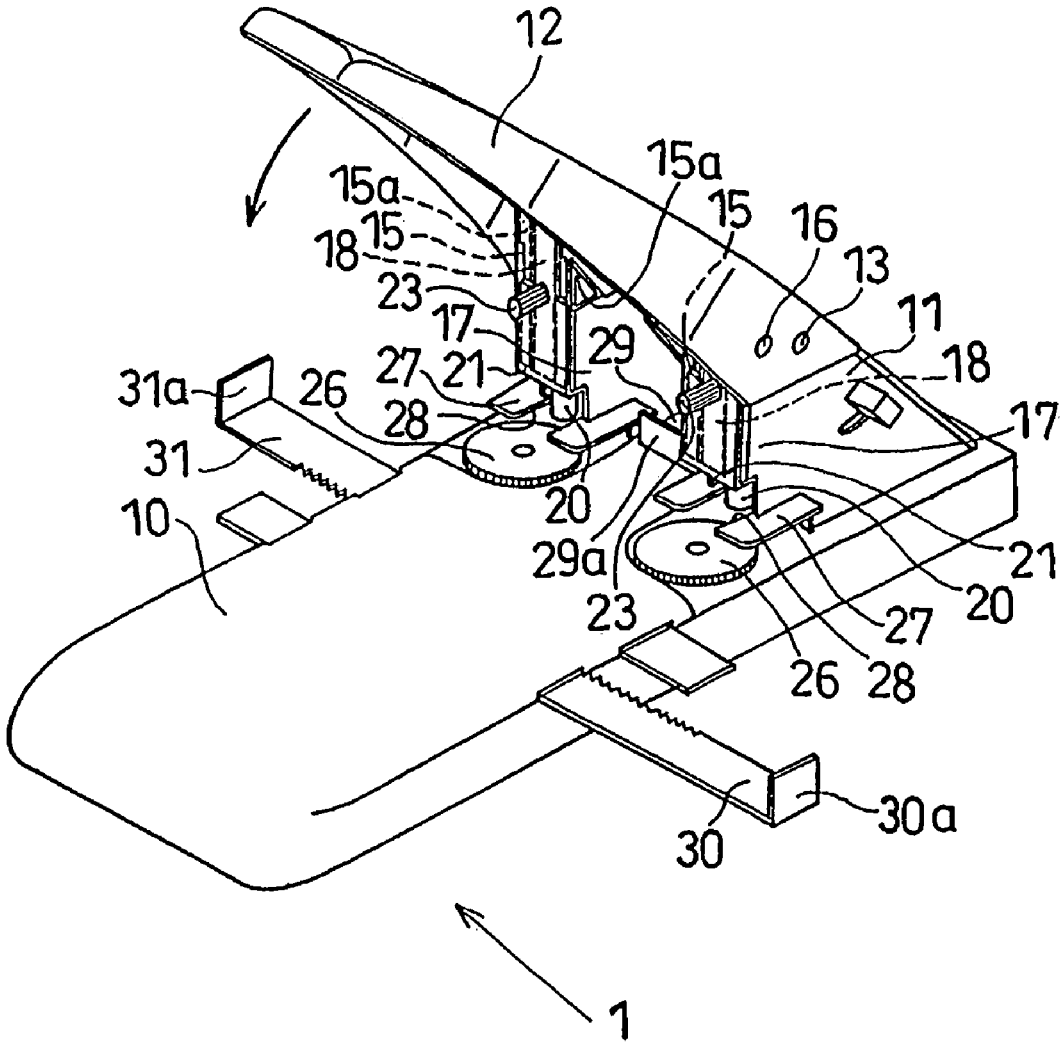
Fig. 21 Prior Art
FIG. 21 is a perspective view of a perforator according to a conventional art.
Figure 22:
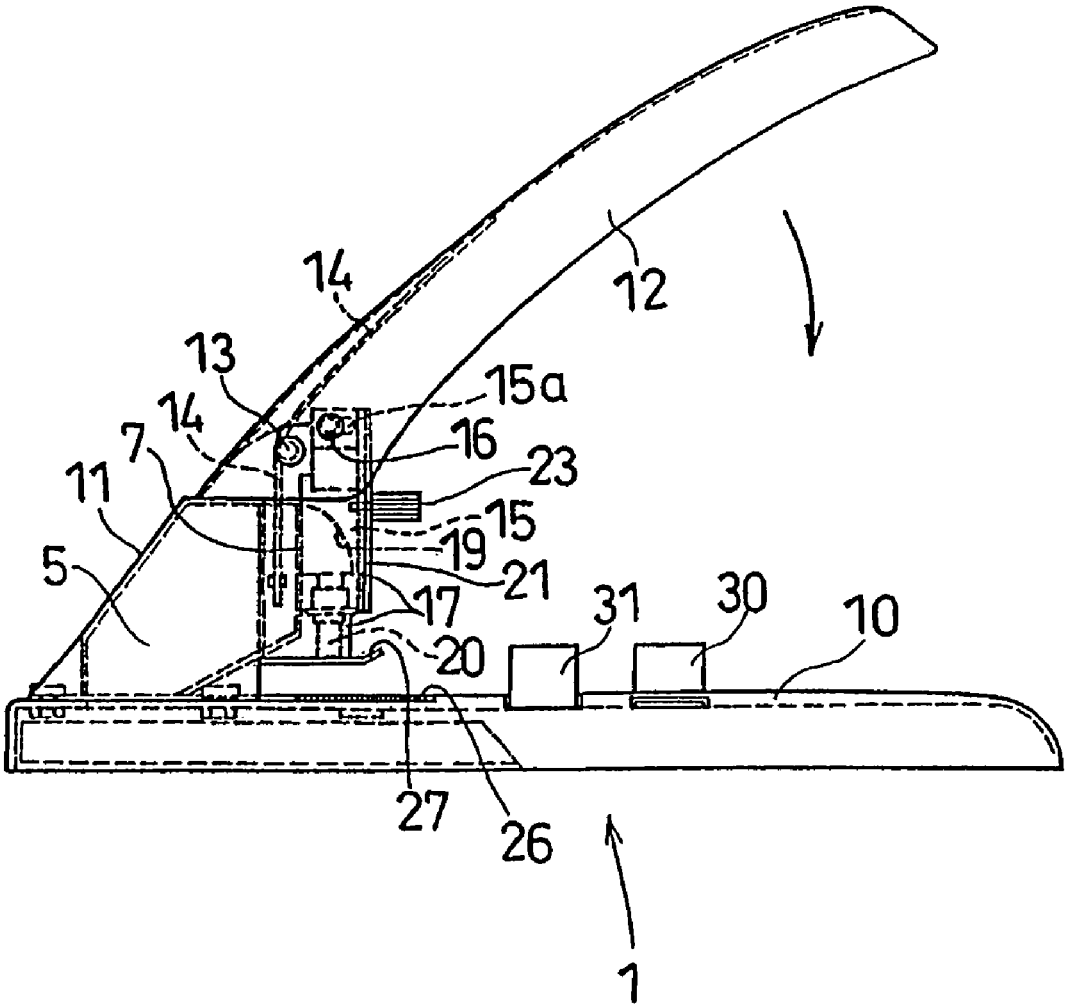
Fig. 22 Prior Art
FIG. 22 is a side view of the perforator in FIG. 21.
Figure 23:
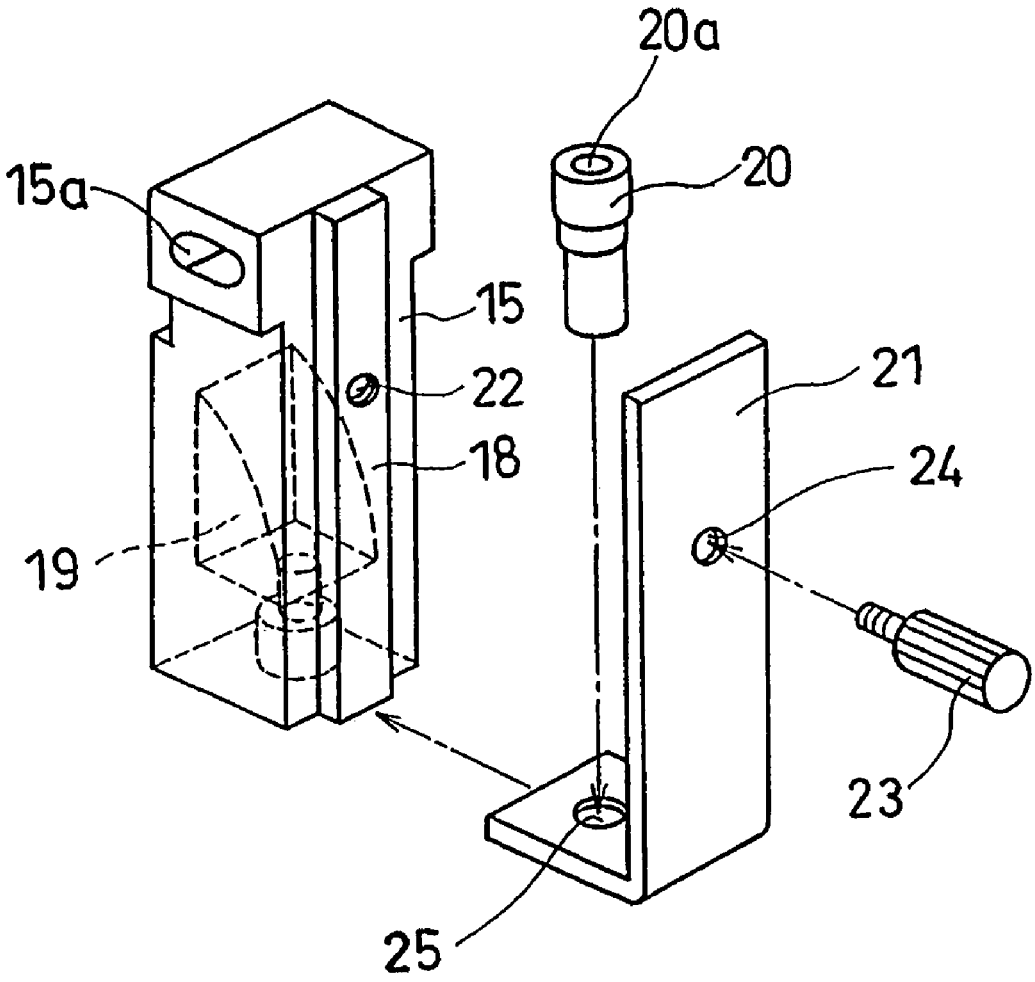
Fig. 23 Prior Art
FIG. 23 is a perspective view of a holder and a support member according to the conventional art.

As shown in FIGS. 21 and 22, in general, the perforator 1 includes an operation base 11 at the top on one side of a substantially rectangular base 10, and a handle 12 rotatably supported by an arm on the operation base 11. To this end, a rotation shaft (not shown) is provided in a hole 13 on a sidewall of the operation base 11 to allow the rotation of the arm supporting the handle 12. In this case, the arm is pushed by a spring 14 (refer to FIG. 22) to position the handle 12 above the operation base 11, thereby facilitating the insertion of a plurality of sheets (not shown) into the base 10. Also, a pair of gauges 30 and 31 (refer to FIG. 21) may be disposed on the light and left sides of the base 10 on which sheets are to be placed, thus keeping the edges of the sheets (not shown) aligned at gauge ends 30*a* and 31*a* to facilitate the positioning for punching operation.

In order to punch a hole in the sheet (not shown) on the base 10, a mounting member 21 (refer to FIG. 23) for mounting a blade 20 so as to face the below from above is attached onto the operation base 11 (refer to FIG. 22). In this case, the mounting member 21 is attached to a support member 15 (refer to FIG. 23) provided in the operation base 11 (refer to FIG. 22).

In order to convert the rotation of the arm to a vertical motion of the mounting member 21, a cam groove (refer to reference numerals 15*a* and 16 in FIG. 22) functioning in response to the rotation is formed at the upper part of the support member 15 to which the mounting member 21 is to be attached, allowing the vertical motion of the support member 15 and the mounting member 21. Alternatively, a link member (not shown) may be provided at the upper part of the support member 15 in place of the cam groove to convert the rotation of the arm into the vertical motion of the mounting member 21. Also, another means other than the cam groove and the link member may be adopted to convert the rotation of the arm to the vertical motion of the mounting member 21.

In this manner, the handle 12 is rotated to move the blade 20 and a plate 27 downward to hold the sheet (not shown) and punch a hole in the sheet. Then, the blade 20 presses a rotary guard 26 (refer to FIGS. 21 and 22) placed on the base 10 and stops at a position slightly cut therein, thereby punching a hole in the sheet. Punch cuttings (not shown) may be released continuously below the perforator 1 by punching operation or, alternatively, may be pushed into the interior of the blade 20 to release upward. In the latter case, the blade 20 is a substantially cylindrical rotary blade. Punch cuttings released from an interior 20*a* of the cylindrical rotary blade 20 to a groove 19 (refer to FIG. 23) in the support member 15 are collected through an opening 7 (refer to FIG. 22) in the operation base 11 into a waste basket 5 (refer to FIG. 22) disposed at the rear (refer to FIG. 22) or in the operation base (not shown).

Subsequently, referring to FIGS. 1 to 10, a holder 100 for mounting the blade 20 to the perforator 1 and a support member 150 functioning in a pair with the holder 100 according to a first embodiment of the present invention will be described hereinbelow with reference to the perforator 1 shown in FIGS. 21 to 23.

Referring initially to FIGS. 1 to 4, a mounting method for the holder 100 and the support member 150 according to the present invention will be described.

Referring now to FIGS. 5 to 10, a configuration of the holder 100 according to the present invention will be described.

Referring again to FIGS. 1 to 4, a mounting structure of the holder 100 and the support member 150 according to the present invention will be described.

In this specification, the word "holder" is broadly defined as a member that detachably supports the blade and can be detachably attached to the support member.

The word "support member" is broadly defined as a member which is attached within the perforator such that it can be moved vertically, to which the holder supporting the blade is detachably attached, and which perform the punching by vertically moving the blade.

The word "perforator" is broadly defined as a device including the support member and an arbitrary mechanism (means) for vertically moving the support member by manual or electrical input for performing the punching.

FIG. 1 is a perspective view of the holder 100 and the support member 150 functioning in a pair therewith, in a state before assembly, according to the first embodiment of the present invention. In addition, an assembly shown in FIG. 1 corresponds to a conventional-art assembly shown in FIG. 23. In the embodiment of the present invention, the holder 100 is assembled to the support member 150 (refer to FIG. 1) provided in the perforator 1. As indicated by the reference numeral 15 in FIGS. 21 to 23, the support member 150 is moved vertically in the perforator 1 to move the blade 20 vertically with the holder 100 for punching operation. Since the holder 100 and the support member 150 are formed to be separate from each other, the blade 20 provided for the holder 100 can freely be replaced as appropriate by disengaging from the holder 100. However, unlike the conventional art, the embodiment of the present invention does not secure the holder 100 to the support member 150 using the screw 23 (refer to FIG. 23) or the like, as shown in the drawing. Alternatively, it is configured such that the holder 100 can smoothly be attached/detached to the support member 150 all the time other than the time when the perforator 1 is being used. The mounting operation, however, is performed in such a manner that the holder 100 is initially attached to the support member 150 and then the state of the holder 100 is changed from a disengaged state to an engaged state.

Figure 2:
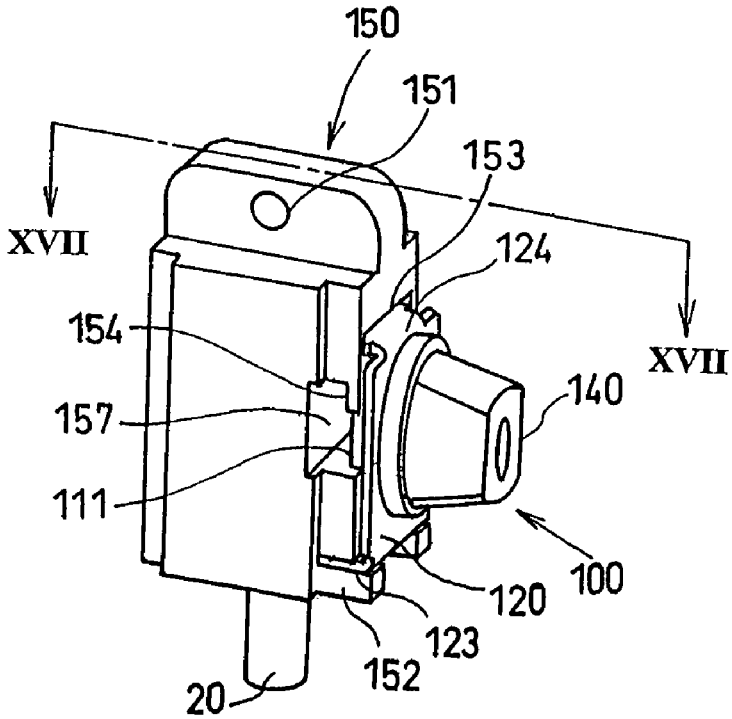
FIG. 2 is a perspective view of the holder and the support member in FIG. 1, in a state immediately after assembly.
Figure 3:
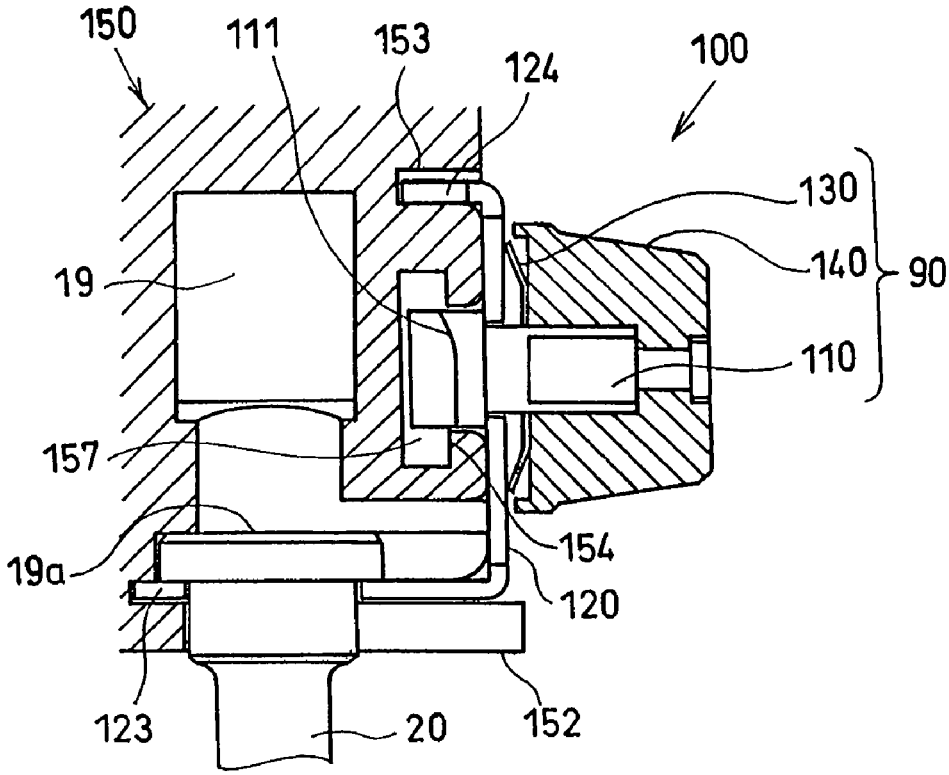
FIG. 3 is a sectional view of the holder and the support member in FIG. 2.

Referring to FIG. 2, a state immediately after the holder 100, shown in FIG. 1, has been assembled onto the support member 150 will be described. As shown in FIG. 2, the holder 100 is assembled to the support member 150 in the perforator 1, along the external shape of a mounting member 120. More specifically, the holder 100 is positioned in place in the support member 150 by bringing engaging sections 123 and 124 (refer to FIG. 1) provided on the mounting member 120 into engagement with retaining sections 152 and 153 provided on the support member 150, respectively. FIG. 3 is a sectional view of the same state. As shown in the drawings, although the holder 100 and the support member 150 are in an assembled position in this state, a hook section 110 (refer to FIGS. 5 and 7A to 7C) of the holder 100 is in a disengaged state, and thus the holder 100 can arbitrarily disengaged from the support member 150. In other words, although the holder 100 and the support member 150 are assembled with each other in this state, both are not fixed to each other.

Figure 4:
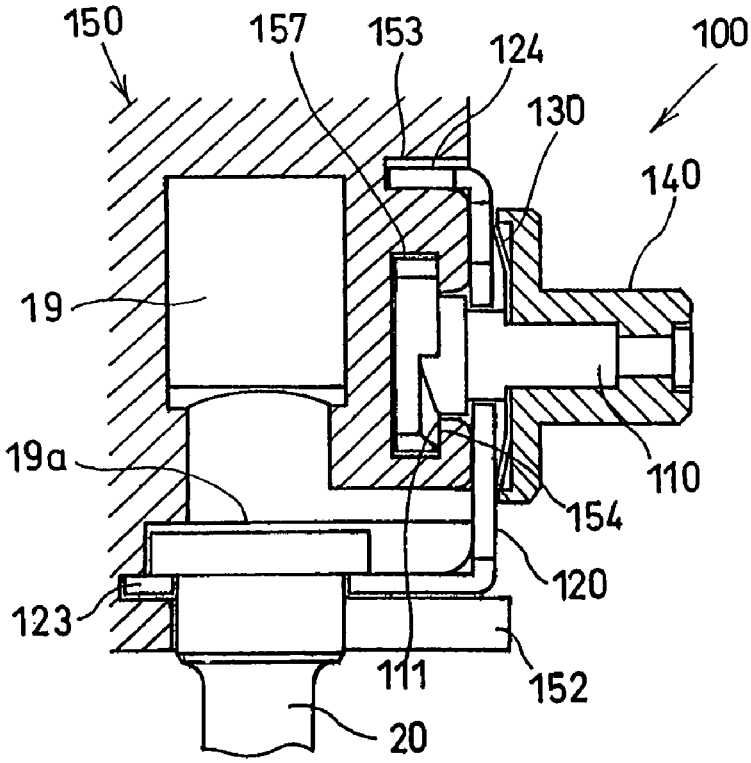
FIG. 4 is a diagram showing a state in which the assembled position of the holder and the support member in FIG. 3 is changed to an engaged state.

FIG. 4 is a diagram showing a state in which an assembled position of the holder 100 shown in FIG. 3 is maintained. More specifically, FIG. 4 shows a state in which the hook section 110 is moved to a position in FIG. 3 to fit an engaging section 111 on the hook section 110 into a groove 154 (refer to FIG. 1) in the support member 150, thereby altering the holder 100 from a disengaged state to an engaged state. In this state, since the holder 100 is in an assembled position and is also altered to an engaged state, the holder 100 cannot easily be disengaged from the support member 150. Therefore, punching operation can be performed with the blade 20 secured in position, that is, without the swinging of the blade 20.

In addition, the engaging sections 123 and 124 and the retaining sections 152 and 153 shown in FIG. 1 have only to have a function of assembling the holder 100 and the support member 150 in position, and may be configured in other various forms, which will be described later in detail.

The holder 100 according to the embodiment of the present invention is attached to the support member 150 in position through the following steps, thereby fixing the blade 20 into the perforator 1.

(0; a disassembled and disengaged step): The holder 100 and the support member 150 are in separated positions from each other (refer to FIG. 1).

(1; an assembled and disengaged step): While the holder 100 and the support member 150 are assembled to each other (refer to FIG. 2), the holder 100 is in a disengaged state (refer to FIG. 3).

(2; an assembled and engaged step): The holder 100 and the support member 150 are assembled to each other, and also the holder 100 is altered from a disengaged position to an engaged state (refer to FIG. 4).

The assembled position, however, is defined as a position at which the holder 100 and the support member 150, which are separated from each other, are assembled detachably with each other.

Furthermore, the engaged state is defined as a state in which the holder 100 and the support member 150, which are separated from each other, are assembled with each other and also cannot easily be disengaged from each other.

On the other hand, in the conventional art disclosed in Japanese Unexamined Patent Application Publication No. 2000-233398, a coil spring is moved vertically to fit the protrusion into the support member and attach the mounting member to the perforator, thereby inserting the mounting member 21 into the support member 15 (perforator 1). In this case, since all the mounting operations are performed in one step, quickness in operation is improved, however, the mounting member 21 sometimes becomes shaky during the operation of the perforator 1. The embodiment of the present invention distinguish between the operation of moving the holder 100 from a disassembled position to an assembled position and the operation of altering the holder 100 from a disengaged state to an engaged state in two steps using a two-position switching member 90 (refer to FIG. 6), as will be described later. This is because, practically, the quickness in operation is hardly altered depending on whether the mounting operation of the holder 100 to the support member 150 is performed in two steps or in one step. Furthermore, what is more important is that improving the stability of the perforator 1 to eliminate the swing of the blade 20 has priority over an increase in the number of operation steps by one.

Accordingly, the embodiment of the present invention solves the technical problem in that the blade 20 becomes shaky during operation, by clearly and mechanically differentiating between the assembled position and the disassembled position and between the engaged state and the disengaged state using the two-position switching member 90.

Hereinafter, the two-position switching member 90 is defined as a member for altering the state of the holder at an assembled position from a disengaged state to an engaged state by switching the position between two positions.

Subsequently, referring to FIGS. 5 to 10, the configuration of the holder 100 according to the present invention will be specifically discussed.

Figure 5:
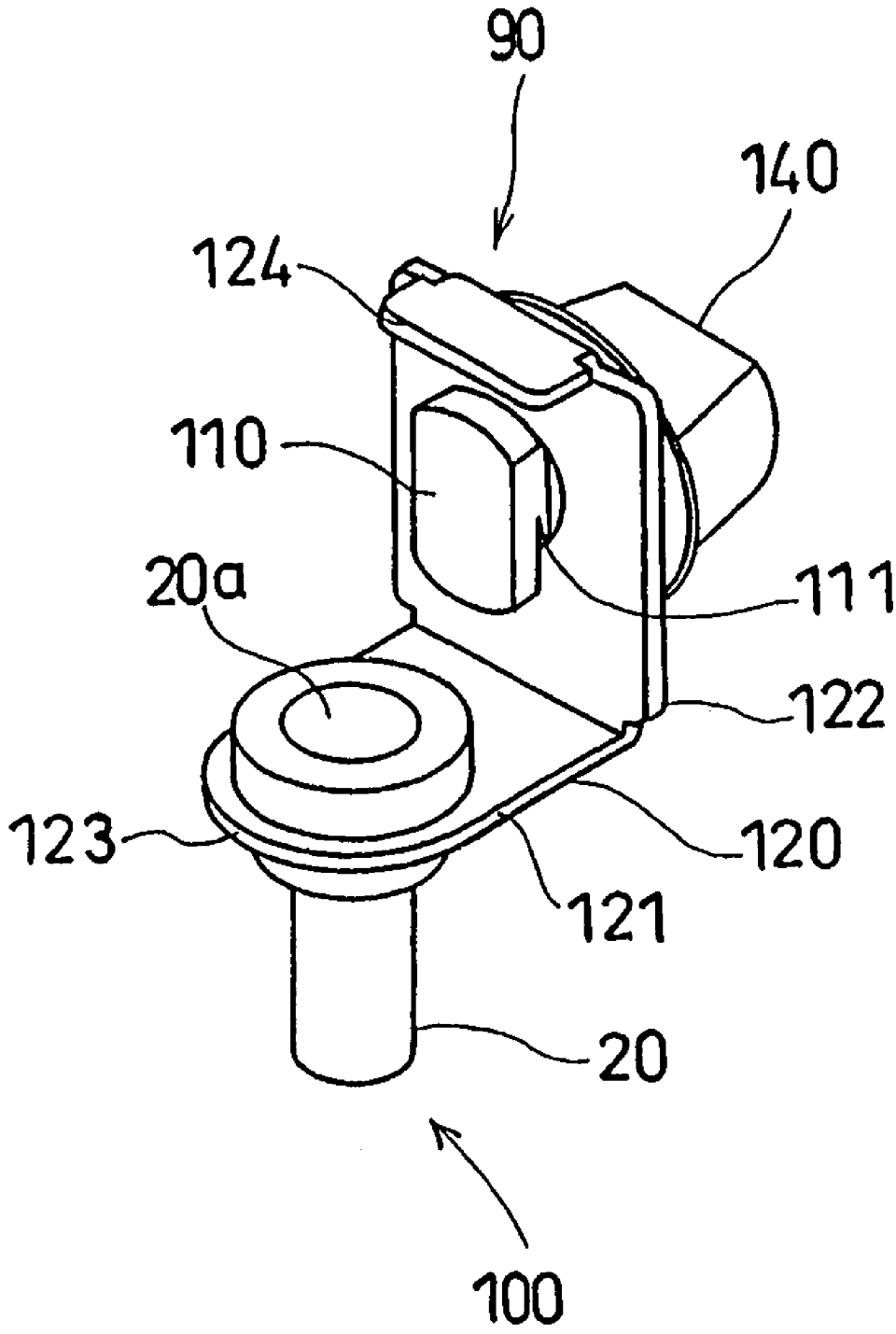
FIG. 5 is a perspective view of the holder according to the first embodiment of the present invention.
Figure 6:
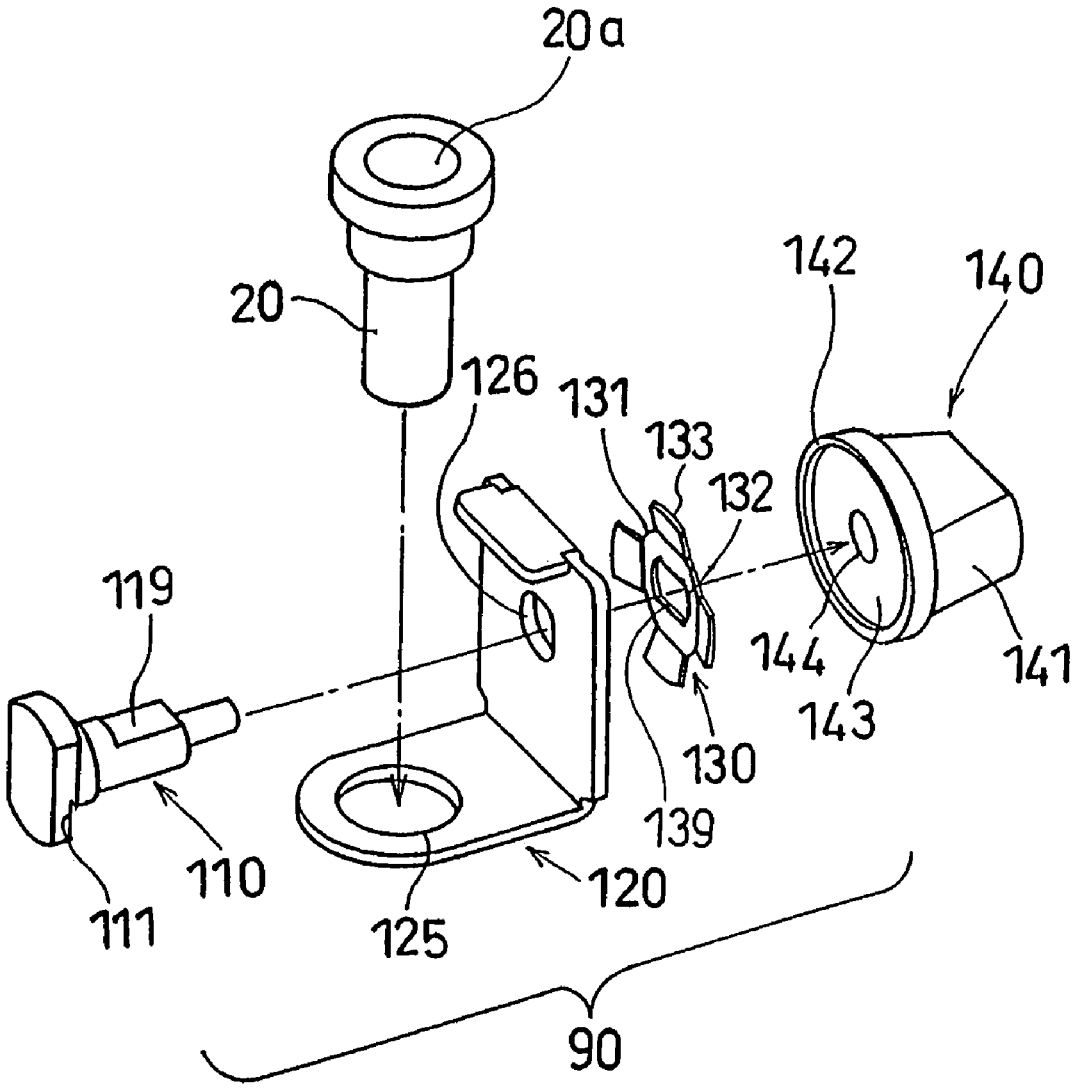
FIG. 6 is an exploded perspective view of the holder in FIG. 5.

FIG. 5 is a perspective view of the holder 100, and FIG. 6 is an exploded perspective view of the same. As understood by FIG. 6, the holder 100 according to the embodiment of the present invention has at least the blade 20, the two-position switching member 90, and a mounting member 120.

Referring to FIG. 5, it shall be understood that the mounting member 120 includes a first mount face 121 for supporting the blade 20 and a second mount face 122 for retaining the two-position switching member 90. Preferably, the first mount face 121 is the bottom face of the mounting member 120 (refer to FIG. 5), and the second mount face 122 is the front face of the mounting member 120 (refer to FIG. 5). The positions of such mount faces, however, may be arbitrarily selected and, particularly, the second mount face 122 may be the front face, the side face, or other faces of the mounting member 120. Also, while the mounting member 120 is preferably formed of a planer member, it is not limited to the planer member structurally as long as for retaining at least the blade 20 and the two-position switching member 90. Also, the mounting member 120 according to the embodiment of the present invention may be formed in any shape other than that shown in FIG. 5. For example, a reinforcement face (not shown) may be formed between the bottom face 121 and the front face 122. However, it is preferably to open the above in order to detachably insert the blade 20.

Preferably, the mounting member 120 has a retaining section (hole) 125 (refer to FIG. 6) on the first mount face 121 for mounting the blade 20, and a retaining section (hole) 126 (refer to FIG. 6) on the second mount face 122 for attaching the two-position switching member 90. The mounting member 120, however, may retain the blade 20 from the right and left by means other than the circular hole 125. That is, the retaining sections 125 and 126 shown in FIG. 6 have only to have a function of retaining the blade 20 and the two-position switching member 90, and are not limited to the circular shape shown in FIG. 6.

Subsequently, the two-position switching member 90 of the holder 100 according to the embodiment of the present invention will be discussed.

As stated above, the two-position switching member 90 according to the embodiment of the present invention has a function of smoothly switching the state of the holder 100 (the disengaged state and the engaged state at the assembled position) by switching two positions of the two-position switching member 90. Therefore, the embodiment of the present invention includes a function of assembling the holder 100 to the perforator 1 and moving the assembled holder 100 into a securely engaged state. While the two-position switching member 90 may be constituted of various components, the preferred embodiment of the present invention is constituted of the hook section 110, an elastic compression member 130, and an operating member 140, as shown in FIG. 6. More specifically, disposing the hook section 110 at the back of the mounting member 120 allows two-position switching operation with them cut off from the outside environment; providing the elastic compression member 130 therebetween gives elasticity to the switching operation; and disposing the operating section 140 in front of the mounting member 120 allows a visible switching operation from the front of the perforator 1.

While the hook section 110 directly switches the two states (the engaged state and the disengaged state) of the holder 100 in response to the input from the operating section 140, the shape of the hook section 110 has only to satisfy the above-mentioned two-position switching function. Also, the hook section 110 includes the engaging section 111 (refer to FIG. 5) to engage with the groove 154 (refer to FIG. 1) of the support member 150, thereby switching the two positions (refer to FIGS. 3 and 4).

Figure 7A:
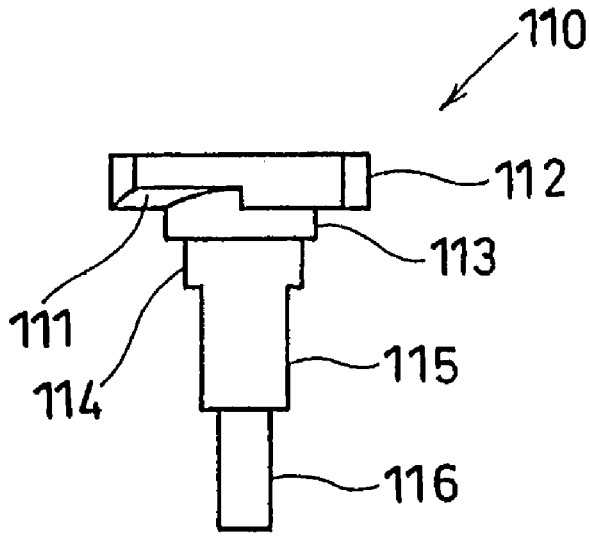
FIGS. 7A to 7C show a hook section according to the first embodiment of the present invention.
Figure 7B:
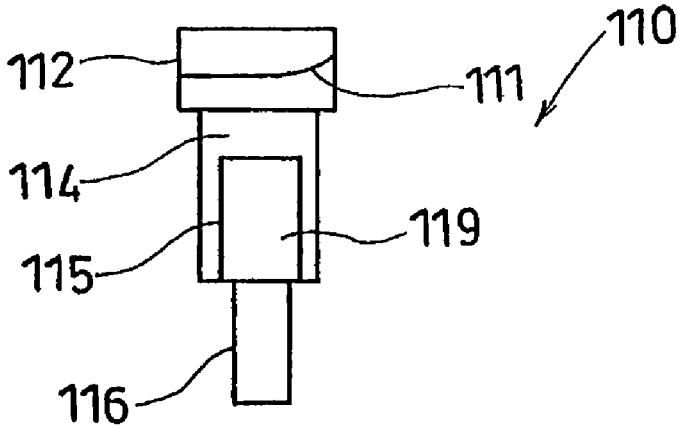
Figure 7C:
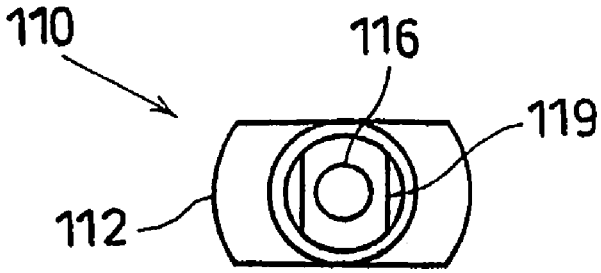

Preferably, the engaging section 111 is tapered. FIGS. 7A to 7C are a front view, a side view, and a plan view of the hook section 110, respectively.

Figure 8A:
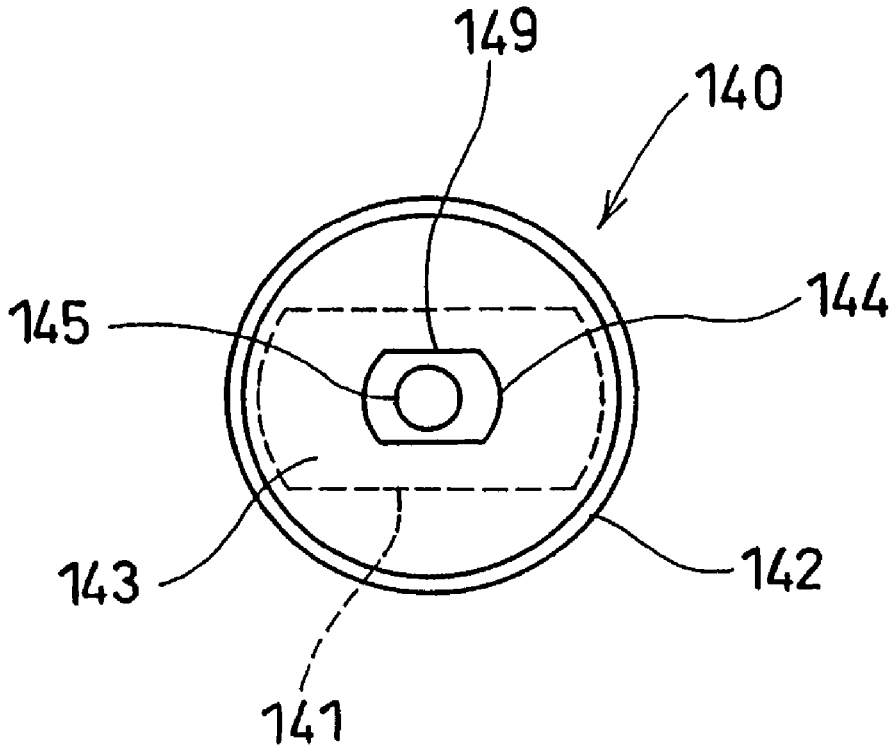
FIGS. 8A and 8B show an operating section according to the first embodiment of the present invention.
Figure 8B:
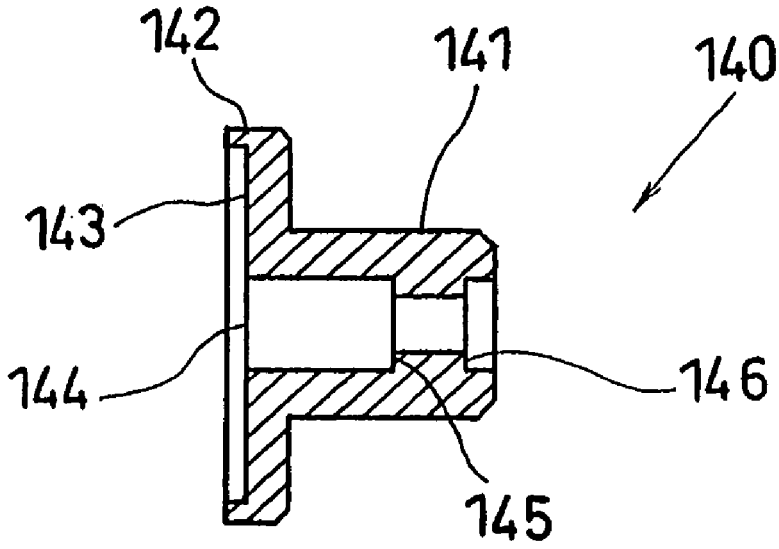

The embodiment of the present invention includes the operating section 140 for operating the hook section 110 on the opposite side thereof with the mounting member 120 sandwiched therebetween, as shown in FIG. 6, thus facilitating manual operation. However, the operating section 140 may arbitrarily be shaped and, for example, a tab 141 (refer to FIG. 1) may be provided or, alternatively, the outer face may appropriately be modified into an easy-to-grip shape. Also, the operating section 140 may have symbols (not shown) at the front, which indicate at which position of the two positions the two-position switching member 90 is positioned. FIGS. 8A and 8B are a front view and a sectional side view of the operating section 140, respectively.

Referring to FIGS. 7A to 7C and 8A and 8B, the shapes of the hook section 110 and the operating section 140 will be discussed hereinbelow. The external shape of the hook section 110 is determined in response to the internal shape of the operating section 140 to be assembled together, and is decreased gradually in diameter from a top 112 toward an end 116 (refer to reference numerals 113, 114, 115, and 116). In this case, in order to fix the substantially cylindrical hook section 110 at a fixed position in the operating section 140, a flat face 119 (refer to FIG. 6 and FIGS. 7A to 7C) is formed on the external face. On the other hand, referring to FIGS. 8A and 8B, the operating section 140 has a hole 144 for receiving the hook section 110 at the top, and a groove (refer to reference numerals 145 and 146 in FIGS. 8A and 8B) communicating with the hole 144 therein. The groove has a decreased-diameter portion 145 in part in correspondence with the external shape of the hook section 110, for receiving the hook section 110 therein and an increased-diameter portion 146 at the end for swaging the end 116 of the hook section 110. Also the groove has a face 149 fitting to the above-mentioned flat face 119 in a pair to position the hook section 110 in the operating section 140.

Referring again to FIG. 6, the elastic compression member 130 will be described. The preferred embodiment of the present invention includes the elastic compression member 130 between the operating section 140 and the mounting member 120 for smoothly switching the two-position switching operation. Preferably, the elastic compression member 130 is a leaf spring, which uniformly disperses a force transmitted from the operating section 140 into the surroundings. To this end, in the preferred embodiment of the present invention, a main body 131 of the leaf spring 130 is formed in a disc-shape, from which engaging arms 133 are each extended uniformly, as shown in FIG. 6. The main body 131 has a hole 132 at the center thereof for receiving the hook section 110. In this case, preferably, the hole 132 includes a horizontal portion 139 for fitting to the flat face 119 of the hook section 110 in a pair. In this case, the hook section 110, the elastic compression member 130, and the operating section 140 always move together. Also, the engaging arms 133 each form an angle with respect to the main body 131, thus elastically dispersing the input applied from the operating section 140 toward the elastic compression member 130 during engagement from the four-side engaging arms 133 (refer to FIGS. 3 and 4). To give an actual example, the engaging arms 133 form an angle of about 15 degrees with respect to the main body 131. Such engaging arms 133, however, have only to have flexibility corresponding to the embodiment as appropriate, and the specific shape, the number, and the angle of the engaging arms 133 may arbitrarily be selected. For example, for increasing elasticity for operation, the angle between the engaging arms 133 and the main body 131 may be set at 25 degrees. On the other hand, in the operating section 140, the main body (tab) 141 is increased in diameter at the top (the left in FIG. 6) for receiving the elastic compression member 130 at the top face 143, and a rim 142 is formed at the periphery thereof for determining the periphery of a thin concave top face 143 (refer to FIGS. 8A and 8B). The engaging arms 133 of the elastic compression member 130 are positioned to the top face 143.

In this manner, assembling the elastic compression member 130 into the two-position switching member 90 imparts elasticity to the two-position switching operation and stabilizes the attaching/detaching operation of the holder 100.

Also, through the use of the elastic compression member 130, the assembled position of the holder 100 at the time of attachment/detachment can be memorized by the holder 100. In this case, however, the elastic compression member 130 has a retaining section (not shown) for retaining the operating position of the two-position switching member 90. More specifically, the retaining section may be a concave cutoff portion (not shown) shaped in a form in which a part of the main body 131 (refer to FIG. 6) is cut off or, alternatively, a protrusion (not shown) protruding from the main body 131. In the former case, preferably, the elastic compression member 130 has the concave cutoff portion (not shown) on the main body 131 thereof, and a protrusion (not shown) on the second mount face (front face) 122 of the mounting member 120, wherein the concave cutoff portion and the protrusion are fitted to each other. In this case, every time the two-position switching member 90 switches the two positions, the concave cutoff portion on the elastic compression member 130 and the protrusion on the second mount face 122 are fitted to each other to precisely determine the position of the two-position switching member 90. In the latter case, a protrusion (not shown) is formed on the main body 131 of the elastic compression member 130, the concave cutoff portion (not shown) is formed on the second mount face (front face) 122 of the mounting member 120 and, similarly, the protrusion and the concave cutoff portion are fitted to each other in a pair. In this way, forming the retaining section (not shown) on the elastic compression member 130 allows the operating position of the two-position switching member 90 to be precisely determined. Therefore, even when the holder 100 is detached from the support member 150, the two-position switching member 90 memorizes the rotating position of the hook section 110 when the holder 100 is detached, thus allowing the holder 100 to be attached to the support member 150 quickly. Furthermore, forming the retaining section on the elastic compression member 130 allows the user to have a sense of recognizing the two-position switching operation. In addition, the retaining section has only to allow the engagement of the elastic compression member 130 and the mounting member 120, and the numbers and the shapes thereof may arbitrarily be selected.

Figure 9:
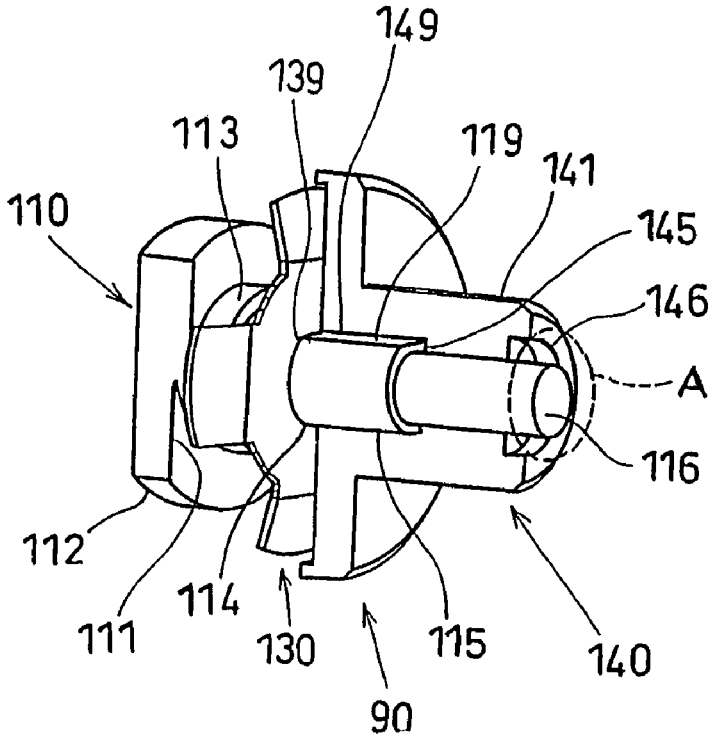
FIG. 9 is a perspective view showing a state in which the hook section is mounted to an assembly of the operating section and an elastic compression member.

Subsequently, referring to FIG. 9, a state in which the hook section 110 is assembled to the aforesaid assembly of the elastic compression member 130 and the operating section 140 will be described. However, it should be understood that while the hook section 110 is normally assembled to the assembly of the elastic compression member 130 and the operating section 140 with the mounting member 120 sandwiched therebetween, as shown in FIG. 6, the mounting member 120 is omitted in FIG. 9 for easy understanding.

As described using FIGS. 7A to 7C, the hook section 110 is gradually decreased in diameter (refer to reference numerals 112, 113, 114, 115, and 116). On the other hand, the operating section 140 assembled in a pair therewith has the grooves 144 and 145 having diameters corresponding to the diameters of the ends 115 and 116 of the hook section 110, respectively (refer to FIGS. 8A and 8B). At that time, the flat face 119 on the hook section 110 and the face 149 in the operating section 140 are fitted to each other, thus they are assembled together at a fixed position. The diameter of the groove 146 at the end of the operating section 140 is increased to swage the hook section 110 and the operating section 140 together. Referring to FIG. 9, when the hook section 110 is assembled to the assembly of the elastic compression member 130 and the operating section 140, the end 116 of the hook section 110 is extended in part (refer to reference symbol A). This is because a pressure is applied to the hook section 110 at the end 116 to be swaged, thereby increasing the diameter of the end 116 to the diameter of the groove 146 at the end of the operating section 140. However, other appropriate fixing methods may be adopted only when conditions for fixing the hook section 110 and the operating section 140 together are met, wherein the hook section 110 and the operating section 140 are modified in shape as appropriate.

In this way, the hook section 110, the leaf spring 130, and the operating section 140 are preferably assembled in a straight line to form the two-position switching member 90 for saving space.

Subsequently, returning to FIGS. 1 and 4, the mounting structure of the holder 100 composed of the blade 20, the two-position switching member 90, and the mounting member 120, and the support member 150 will be described.

As shown in FIG. 1, when the holder 100 is assembled to the support member 150, the assembly is in a disengaged state immediately after assembly, as shown in FIGS. 2 and 3. However, since the hook section 110 is rotatably fitted in the groove 157 of the support member 150 at the decreased-diameter portion 113 (refer to FIGS. 7A to 7C), the holder 100 can be switched to the engaged state shown in FIG. 4 by rotating the hook section 110 in the groove 157. For this purpose, preferably, the hook section 110 has the tapered engaging section 111 (refer to FIGS. 7A to 7C), and the support member 150 has the groove 154 fitted to the aforesaid tapered face in a pair, as shown in FIG. 1. Preferably, two tapered faces 111 are arranged on the diagonal on the hook section 110, thus facilitating the rotating operation of the two-position switching member 90. Also, two grooves 154 are formed on the diagonal on the groove 157 so as to correspond to the tapered faces 111 on the diagonal.

By rotating the two-position switching member 90 from the position shown in FIG. 3 to the position shown in FIG. 4, the tapered face 111 is fitted to the groove 154 of the support member 150, and the elastic compression member 130 is brought into pressure contact therewith, as shown in FIG. 4. At that time, the tapered face 111 is switched from a horizontal position (refer to FIG. 3) to a vertical position (refer to FIG. 4) to abut against a stop surface (refer to FIG. 1) of the groove 154, so that the hook section 110 stops the rotation in the groove 157. In this manner, the two-position switching member 90 operates while sandwiching the support member 150 and the mounting member 120 at the top 112, and the top 112 has the tapered face 111 for fitting into the groove 154 in the perforator 1, thereby ensuring the engaged state of the holder 100. The tapered face 111 and the groove 154 are not easily disengaged from each other unless the operating section 140 is moved in the opposite direction.

FIGS. 3 and 4 are conceptual diagrams attached for explanation and it should be understood that the shapes of the tapered face 111 and the groove 154 are modified in accordance with the embodiment as appropriate.

Figure 10:
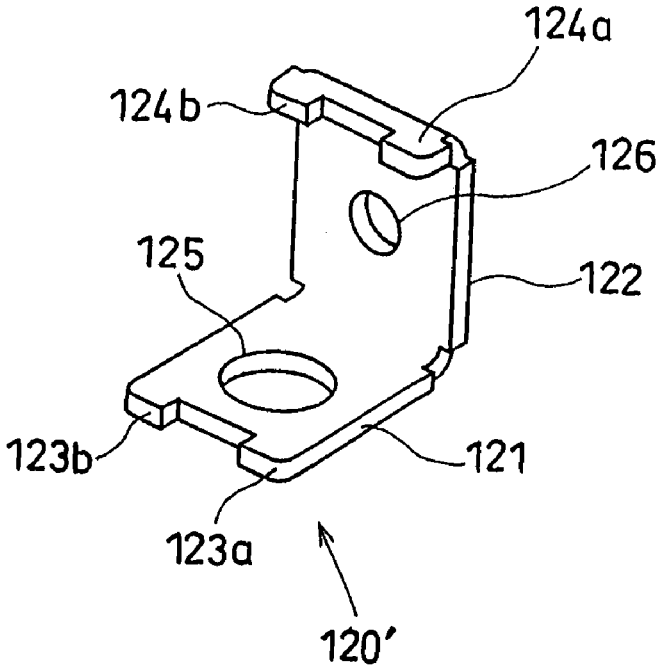
FIG. 10 is a perspective view of a mounting member according to another embodiment of the present invention.

As stated above, the holder 100 is assembled to the support member 150 along the external shape of the mounting member 120 using the two-position switching member 90. Also, in order to assemble the holder 100 along the external shape of the mounting member 120, the engaging sections 123 and 124 (refer to FIG. 1) are formed on the mounting member 120. Therefore, the holder 100 can easily be inserted into the support member 150, thus improving an assembly characteristic. Such engaging sections 123 and 124 have only to have a function of positioning the holder 100 and the support member 150 in place, and may be modified to various shapes. For example, as shown in FIG. 10, the mounting member 120' having two pairs of left and right engaging sections 123*a* and 123*b*, and 124*a* and 124*b* may be provided. Also, the engaging sections may be provided on other portions of the mounting member 120'. For example, the engaging sections of the mounting member 120' need not always position the mounting member 120' to the support member 150 back and forth, but may position, for example, in the lateral direction (not shown). However, it should be understood that, in the case of the shape shown in FIG. 10, the support member functioning in a pair with the mounting member 120' is also modified in external shape (not shown) to engage with the engaging sections 123*a*, 123*b*, 124*a*, and 124*b*.

In this manner, by providing the holder 100 shown in FIGS. 5 to 10 to the support member 150 shown in FIGS. 1 to 4, the blade 20 can be detachably secured to the perforator 1 shown in FIGS. 21 and 22 smoothly and stably. Also positioning the holder 100 at the position shown in FIG. 4 allows stable punching operation with the perforator 1.

When the blade 20 is the substantially cylindrical rotary blade, as described above, the punching operation is performed while releasing the punch cuttings upward. In this case, as shown in FIG. 1, the support member 150 has a groove 155 for positioning the blade 20 and a groove (clearance groove) 156 for releasing the punch cuttings above the groove 155. This is because when the blade 20 is detachably mounted to the support member 150 without the groove 156 formed above the groove 155, there is no gap between the groove 155 and the blade 20, as supposed from FIG. 2, punch cuttings could be caught during mounting/demounting operation. Therefore, in the embodiment of the present invention, the groove 156 is formed in the support member 150, thereby mounting/demounting the blade 20 having a shape to release the punch cuttings particularly from below to above without operational troubles.

The above-described holder 100 for mounting the blade 20 to the perforator 1 can be made of various materials including metal and plastic. Also the holder 100 may be modified in size as appropriate in accordance with the embodiment and, for example, two or more blades 20 may be provided. The perforator 1 used with the holder 100 is not limited to this embodiment, but may be of a desktop type or of a more compact type.

Subsequently, referring to FIGS. 11 to 20, a support member according to a second embodiment of the present invention including a punch-cuttings drop prevention device will be described.

Figure 11:
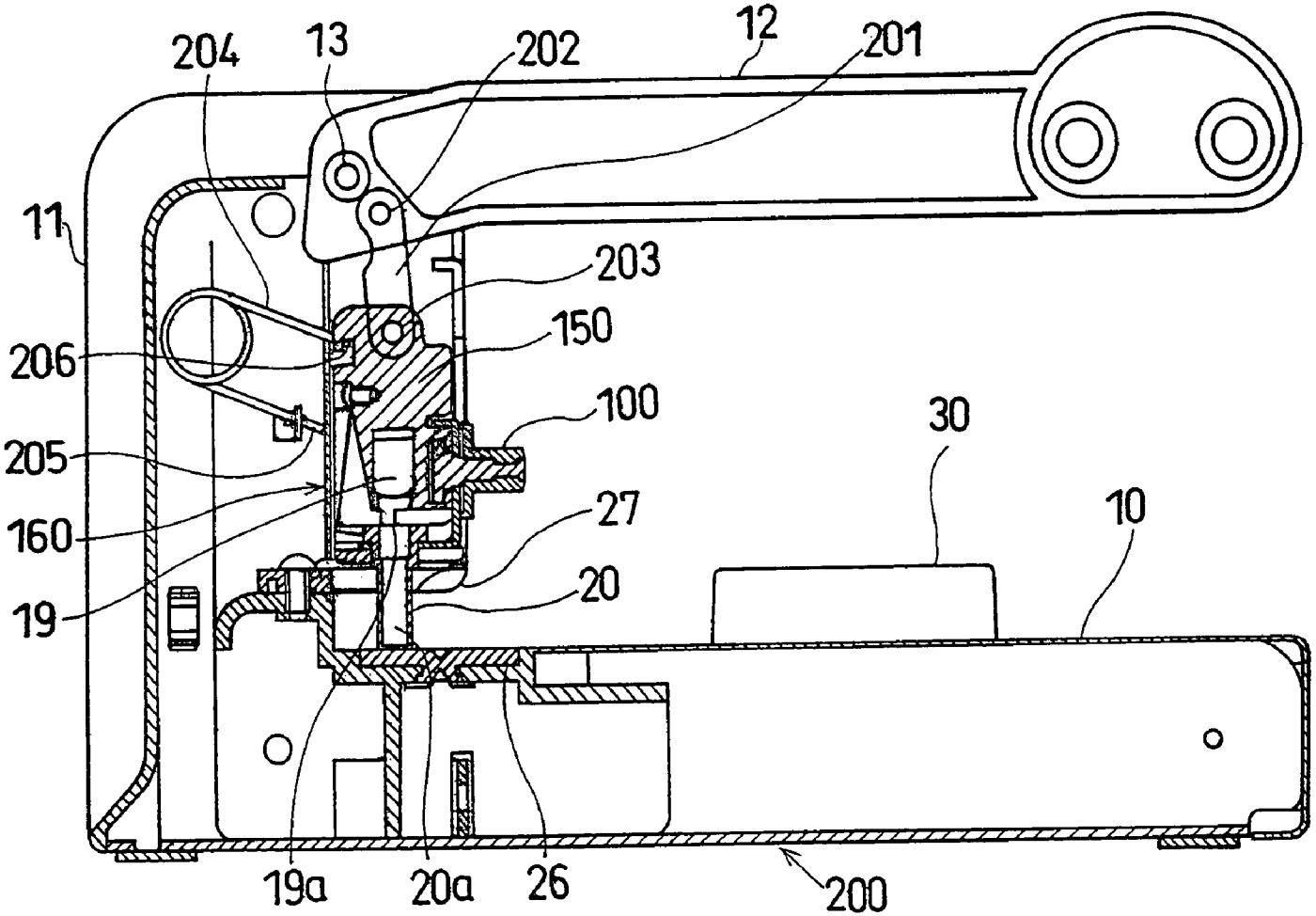
FIG. 11 is a schematic view of a perforator having a support member according to a second embodiment of the present invention.
Figure 12:
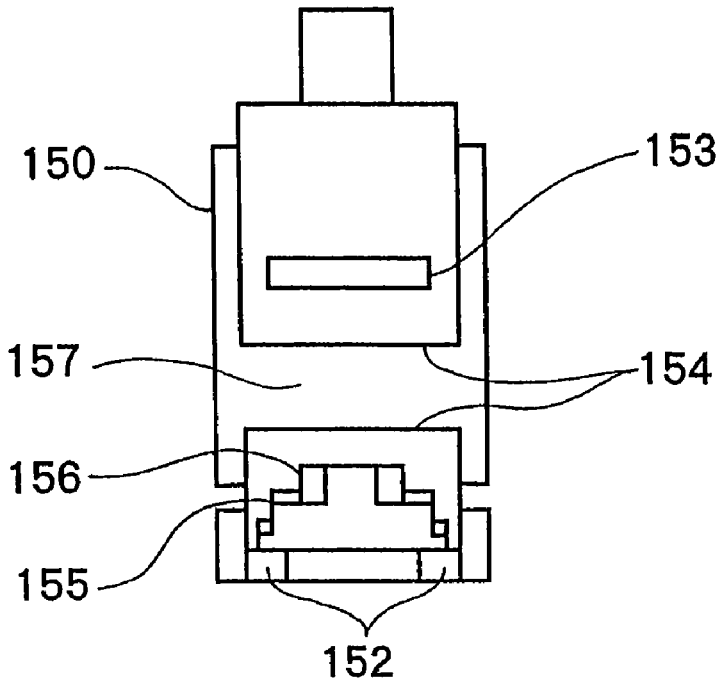
FIG. 12 is a front view of the support member according to the second embodiment of the present invention.

FIG. 11 shows a perforator 200 that mounts a support member 150 including a punch-cuttings drop prevention device 160, to which the holder 100 for supporting the blade 20 is assembled in an engaged state. As shown in the drawing, the perforator 200 is configured to rotatably support the arm (operating section) 12 on the operation base 11 above the base 11 and to interlock the arm 12 with the support member 150 for movement using a link device. More specifically, one end 202 of a connecting rod 201 is connected to the end of the arm 12 and the other end 203 is connected to the support member 150, respectively, in revolute pair. Therefore, by rotating the arm 12, the rotation of the arm 12 can be converted into the vertical motion of the support member 150. Where one end 205 of a spring 204 is secured to the operation base 11 and the other end 206 is attached to the support member 150. So that the support member 150 is biased by the spring 204 to return to an initial position when moving vertically.

With such a configuration, by rotating the arm 12 by manual input, the blade 20 and the plate 27 are moved downward along with the support member 150 to hold down sheets (not shown) aligned by the gauge 30 on the base 10 and to punch the sheets. The blade 20 presses the rotary guard 26 placed on the base 10 and stops at a position slightly cut therein, thereby punching the sheets. At this time, punch cuttings (not shown) generated during the punching are pushed into the interior 20*a* of the blade 20 and are then collected above. The punch cuttings released from the interior 20*a* of the blade 20 to the groove 19 inside the support member 15 are collected into a cuttings container (not shown).

The perforator 200, shown in FIG. 11, is only one embodiment using the support member 150 according to the second embodiment of the present invention, but the rotational motion of the arm 12 may be converted into a vertical motion of the support member 150 by a cam groove formed at the upper part of the support member 150. Furthermore, the rotational motion of the arm 12 may be converted into the vertical motion of the support member 150 by means other than the link device.

Figure 16:
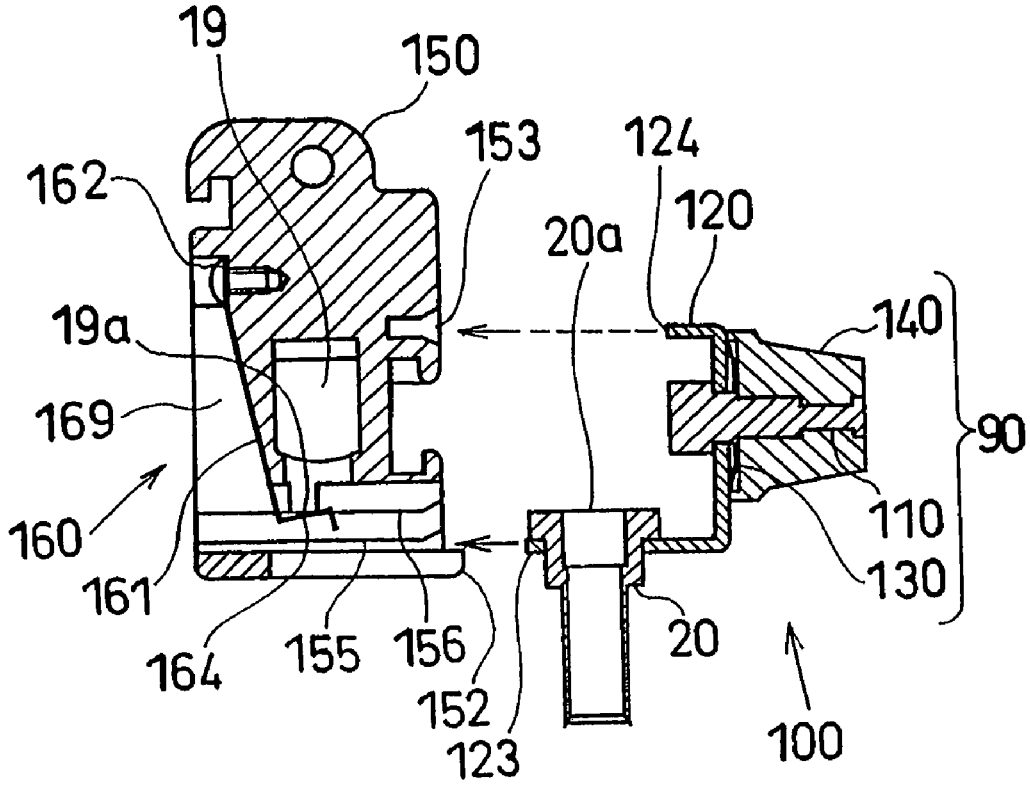
FIG. 16 is a sectional view showing a step in which the support member and the holder supporting the blade, shown in FIG. 11, are separated from each other.
Figure 17:
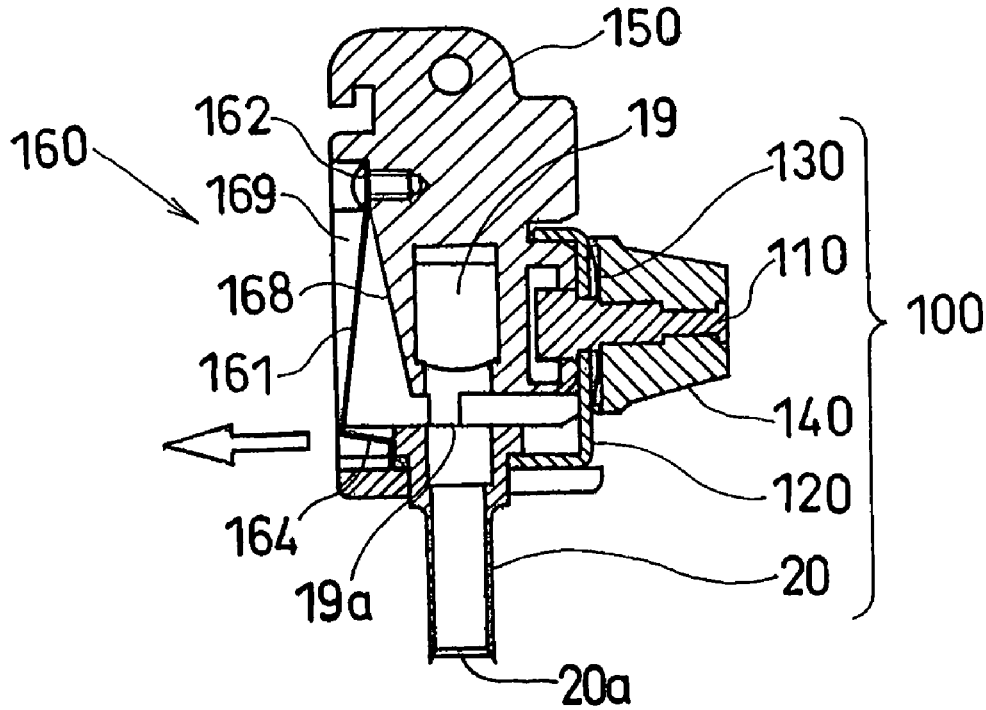
FIG. 17 is a sectional view showing an assembled step of the holder and the support member, shown in FIG. 16.
Figure 18:
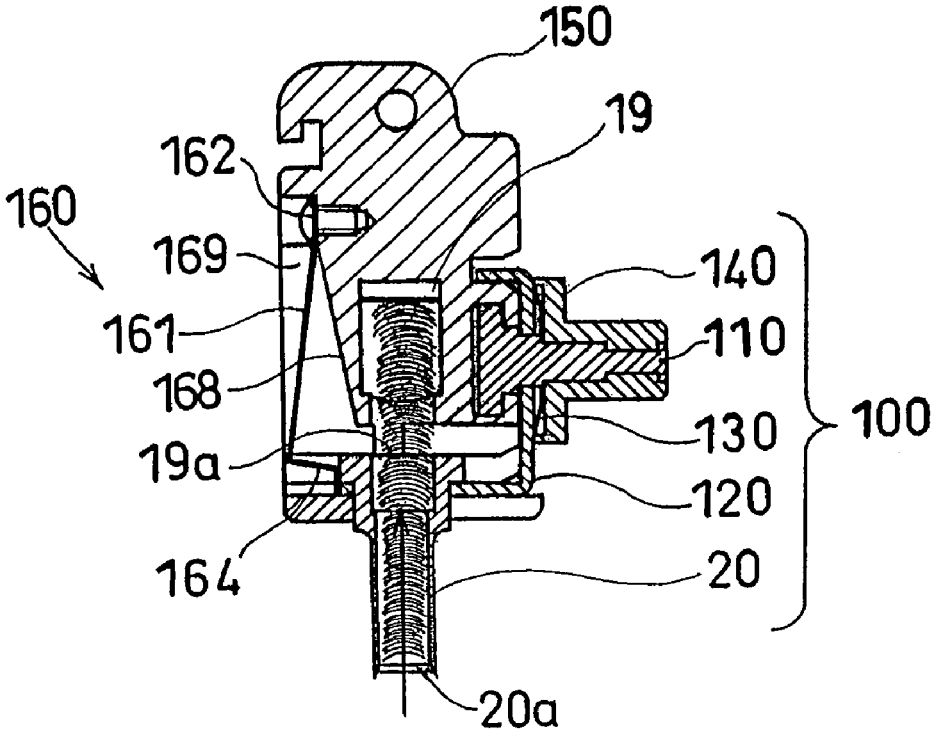
FIG. 18 is a sectional view showing an engaged step in an assembled position of the holder and the support member, shown in FIG. 17.

As described above, in the second embodiment according to the present invention, while the support member 150 is detachably attached to the holder 100, the holder 100 is attached to the support member 150 in position through the following steps, as shown in FIGS. 16 to 18, as in the first embodiment of the present invention, shown in FIGS. 1 to 4.

(0; a disassembled and disengaged step): As shown in FIG. 16, the holder 100 and the support member 150 are in separated positions from each other. At this time, the mounting member 120 supports the blade 20, and the hook section 110, the elastic compression member 130, and the operating section 140 support the two-position switching member 90.

(1; an assembled and disengaged step): Subsequently, as shown in FIG. 17, the engaging sections 123 and 124 provided on the mounting member 120 and the retaining sections 152 and 153 provided on the support member 150 are brought into engagement with each other, respectively, so that the holder 100 is positioned in place in the support member 150. At this time, the holder 100 and the support member 150 are assembled to each other, however, in this state, the holder 100 can arbitrarily be disengaged from the support member 150 and is therefore in a disengaged state.

(2; an assembled and engaged step): As shown in FIG. 18, the operating section 140 is rotated to rotate the hook section 110 integrated with the operating section 140 in the groove 157 with the elastic compression member 130 being compressed (refer to FIG. 4). At this time, the hook section 110 is rotated in the groove 157 until abutting against a stop face 159 (refer to FIG. 1) of the groove 154, thereby bringing the tapered face 111 (refer to FIG. 3) at the end thereof into engagement with the groove 154 in the support member 150. The engagement between the tapered face 111 and the groove 154 is not easily disengaged unless the operating section 140 is moved in the opposite direction. Accordingly, by assembling the holder 100 and the support member 150 to each other and rotating the two-position switching member 90, the holder 100 is altered from a disengaged state to an engaged state.

FIGS. 16 and 17 are sectional views taken along line XVI—XVI in FIG. 1 and line XVII—XVII in FIG. 2, respectively.

Figure 14:
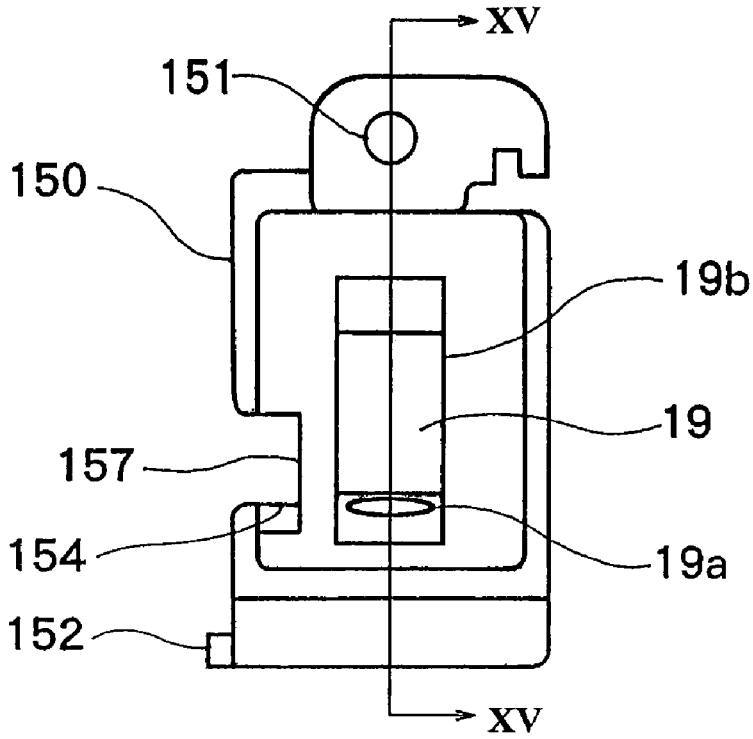
FIG. 14 is a side view of the support member shown in FIG. 12.
Figure 15:
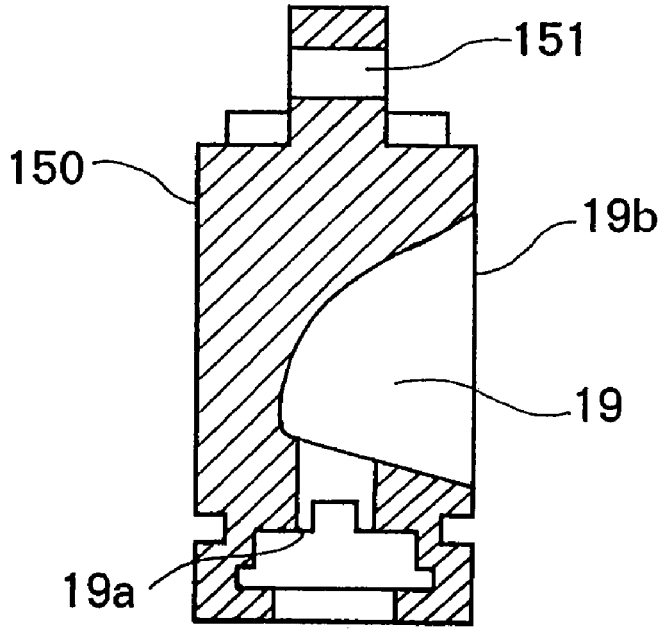
FIG. 15 is a sectional view of the support member shown in FIG. 14, taken along line XV—XV.

As described above, in the second embodiment of the present invention, preferably, punch cuttings generated during the punching are released from the interior 20*a* of the blade 20 to the groove 19 inside the support member 150. For this purpose, as shown in FIGS. 14 and 15, an opening 19*a* connecting to the interior 20*a* of the blade 20 is formed at the lower part of the groove 19, through which the punch cuttings are released. Moreover, an opening 19*b* is formed at the side of the groove 19 to collect the punch cuttings released to the groove 19 into cuttings container (not shown) provided to the perforator 200.

Figure 13:
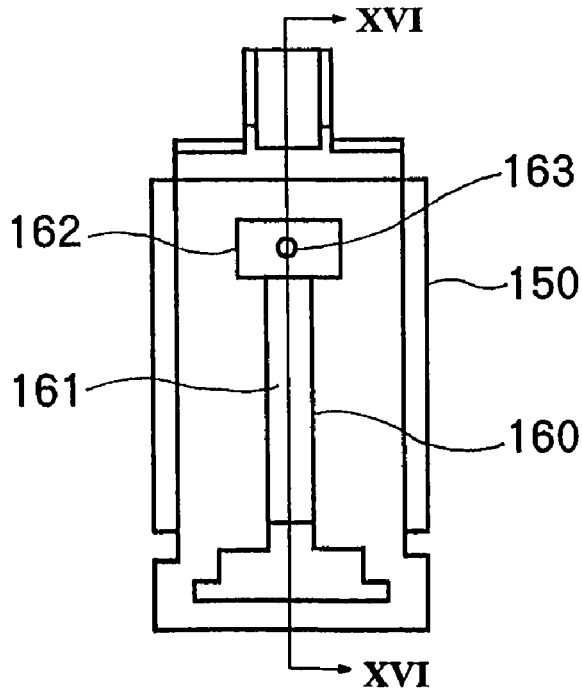
FIG. 13 is a back view of the support member shown in FIG. 12.
Figure 19:
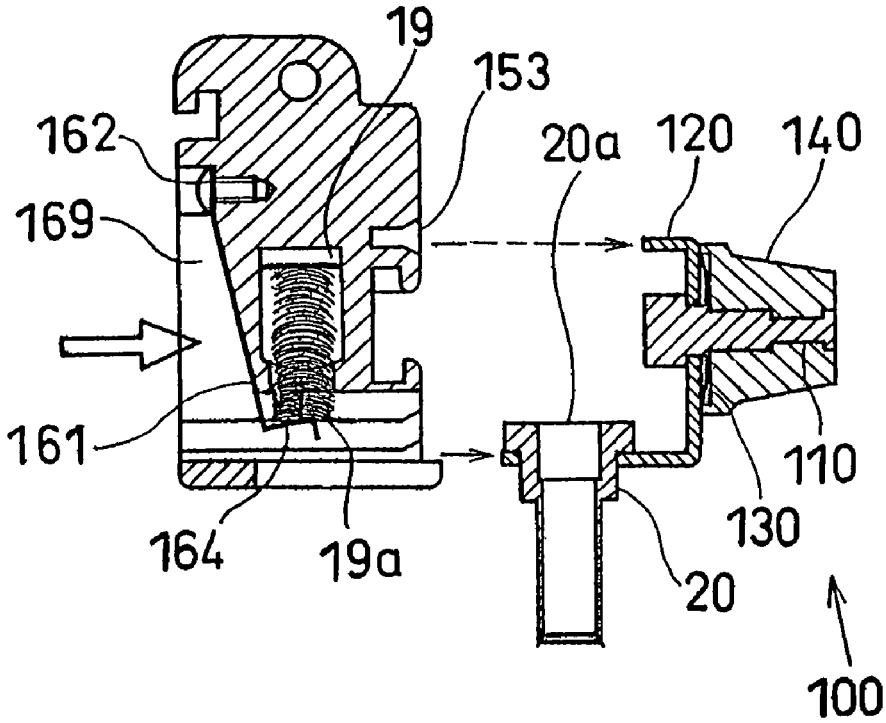
FIG. 19 is a sectional view showing a state in which the support member and the holder supporting the blade, shown in FIG. 18, are separated again.

With this configuration, however, when the holder 100 is disengaged from the support member 150, the opening 19*a* is not no longer connected to the interior 20*a* of the blade 20, and accordingly, the punch cuttings remaining in the groove 19 in the support member 150 sometimes drop downward through the opening 19*a*. This in itself poses no problems in the function of the perforator, however, it is not desired to litter the surroundings. Also, in the embodiment of the present invention, it is conceivable that the holder 100 may be disengaged from the support member 150 more frequently because the replacement of the blade 20 is further facilitated as compared with the related art. In this case, every time the holder 100 is disengaged from the support member 150, the punch cuttings remaining in the support member 150 are partly scattered to litter the work environment. Accordingly, in the second embodiment of the invention, as shown in FIG. 13, the support member 150 includes the punch-cuttings drop prevention device 160 that shields the opening 19*a* in the support member 150 and when the interior 20*a* of the blade 20 and the opening 19*a* is disconnected from each other after punching, the punch cuttings remaining in the groove 19 is prevented from dropping downward through the opening 19*a*, as shown in FIG. 19.

In this specification, the word "shield" is defined as a state in which at least part of the opening 19*a* in the groove 19 is covered to obstruct circulation of the punch cuttings. In this case, there is no need to cover the entire area of the opening 19*a* and to closely cover the opening 19*a*.

Preferably, however, the punch-cuttings drop prevention device 160 has elasticity and communicates the opening 19*a* with the interior 20*a* of the blade 20 when the holder 100 is mounted (refer to FIG. 18), and shields the opening 19*a* quickly by the elasticity.

In this specification, the word "elasticity" is defined as a property of applying a force to a rigid body (elastic body) for shielding the opening 19*a* in the groove 19 to thereby move it to a not-shielded withdrawn position and to return it again to an initial position when the force is eliminated.

The structure of the punch-cuttings drop prevention device 160 will be specifically described hereinbelow.

In the second embodiment of the present invention, as shown in FIG. 16, the punch-cuttings drop prevention device 160 includes an elastic body 161 for shielding the opening

19*a* in the groove 19 for releasing the punch cuttings, and an operating space (groove) 169 in which the elastic body 161 is moved between a shield position (refer to FIGS. 16 and 19) and a withdrawn position (refer to FIGS. 17 and 18) for opening the opening 19*a*.

Figure 20A:
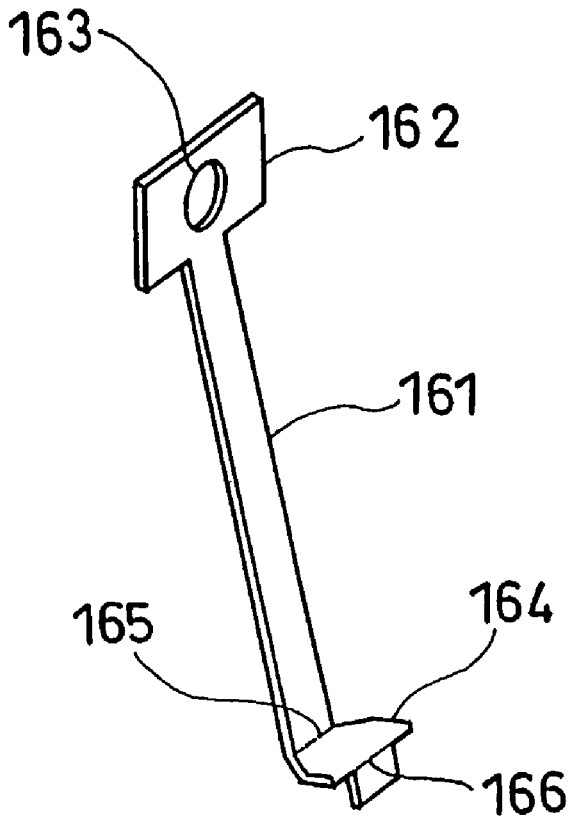
FIGS. 20A and 20B are diagrams of leaf springs according to the second embodiment of the present invention.

More specifically, as shown in FIG. 16, when the groove 19 is formed within the support member 150, a groove 169 is formed in the vicinity thereof. Although the specific size and position of the groove 169 are optional, preferably, it is positioned in an opposite side (back side) of the side (front side) to which the holder 100 is attached, and the elastic body 161 is accommodated therein for shielding the opening 19*a* adjacent thereto. Preferably, as shown in FIG. 20A, the elastic body 161 includes a long main body, at one end of which an attachment 163 is provided and fixed to the upper part of the groove 169 with a screw, and the other end 164 is extended from the groove 164 to shield the opening 19*a* in the groove 19. At this time, the main body of the elastic body 161 is decreased in width and thickness, whereby when a load is applied to the end 164, the elastic body 161 can smoothly be moved from a position to shield the opening 19*a*, shown in FIG. 16, to a withdrawn position to open the opening 19*a*, shown in FIG. 17. Preferably, the elastic body 161 is a leaf spring.

Now, the device adapted to shield the opening 19*a* at the end 164 of the leaf spring (elastic body) 161 will be specifically described.

Referring to the drawings, the upper end 162 of the main body is fixed and the lower end 164 shields the opening 19*a* in the groove 19 of the support member 150. However, as shown in FIG. 16, since the opening 19*a* is positioned above the end 164 extending downward, in order to shield the opening 19*a*, the end 164 is once bent upward, as shown in FIG. 20A, and the bent portion (first bent portion) 165 shields the opening 19*a*. Furthermore, as shown in FIG. 17, the leaf spring 161 needs to be brought into contact with the separate holder 100 at the end 164 and to be pushed from the operating position to the withdrawn position. At this time, the holder 100 is brought into contact with the leaf spring 161 at the end of the mounting member 120, and is positioned below the opening 19*a*. Therefore, as shown in FIG. 20A, the end 164 is again bent below and a bent portion (second bent portion) 166 comes into contact with the end of the holder 100, which is inserted under the opening 19*a*. Also, in the second embodiment, the main body of the leaf spring 161 is increased in width at the first bent portion 165, thereby enhancing the function of shielding the opening 19*a*, however, the shape of the end 154 that shields the opening 19*a* is optional, and may be a substantial circle along the periphery of the opening 19*a*, and alternatively, may be like a polygon, as shown in FIG. 20A. Either shape provides the function of preventing the punch cuttings from circulating through the opening 19*a*.

Figure 20B:
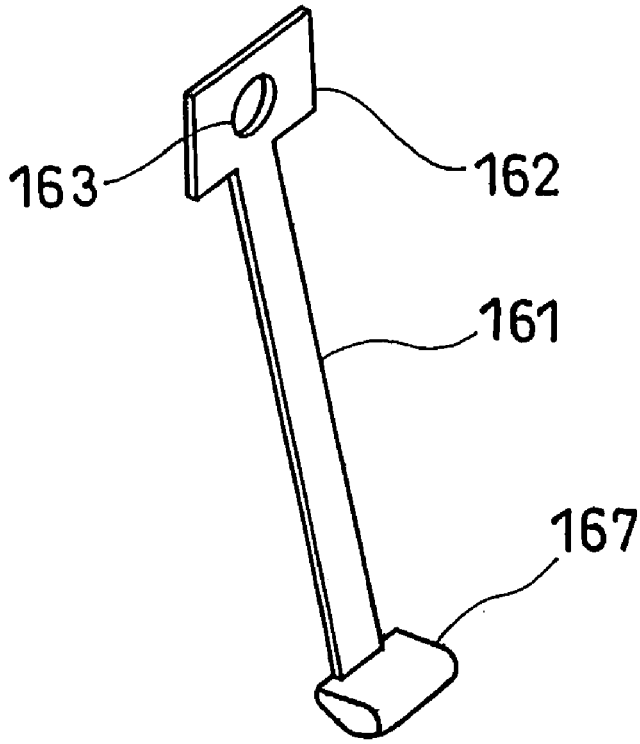

The leaf spring 161 is configured such that the end 164 that shields the opening 19*a* is integrated with the main body, however, for example, another embodiment of the present invention may be configured such that the leaf spring 161 may include a separate operating section 167 attached to the end thereof, as shown in FIG. 20B. In the embodiment shown in FIG. 20B, the operating section 167 is not bent, but is large in thickness, thus providing a device adapted to shield the opening 19*a* and to come into contact with the holder 100.

Since the leaf spring 161 is configured as described above, the end 164 is warped backward from a position to shield the opening 19*a* with one end 162 used as a supporting point when a force is applied to the end 164, as shown in FIG. 17. The leaf spring 161, however, has elasticity, thus generating no plastic elasticity in the main body of the leaf spring 161 when the main body of the leaf spring 161 is warped backward. As shown in FIG. 17, when the leaf spring 161 is warped backward by pushing the end 164 of the leaf spring 161, the main body of the leaf spring 161 accumulates elastic potential energy and, furthermore, as shown in FIG. 19, when the holder 100 is removed from the support member 150 and a force applied to the end 164 is eliminated, the leaf spring 161 releases the accumulated elastic potential energy and moves quickly to an initial position to shield the opening 19*a*.

In the second embodiment of the present invention, as shown in FIG. 17, the groove 169 is formed inclined within the support member 150 and, as shown in FIG. 16, the leaf spring 161 is normally positioned on a inclined surface 168 thereof. Since the inclined surface 168 is formed, on which the leaf spring 161 is positioned, the oscillating end 164 does not allowed to project outward from the support member 150 either at the operating position to shield the opening 19*a* or at the withdrawn position to open the opening 19*a*, whereby the perforator 200 can be configured compact. However, the inclination angle of the inclined surface 168 is optional, and the scope of the claims of the present invention should not be restricted by a specific angle thereof. Furthermore, in the second embodiment of the present invention, as shown in FIG. 13, while the backside of the support member 150, which forms the groove 169, is opened, it is possible to attach a lid (not shown) thereto to prevent the punch-cuttings drop prevention device 160 provided in the support member 150 from being exposed to the external environment.

The punch-cuttings drop prevention device 160 according to the second embodiment of the present invention is configured as described above, wherein it moves to an operating position in the disassembled and disengaged step (step 0) in which the holder 100 and the support member 150 are at separate positions, and moves to a withdrawn position in the assembled step (steps 1 and 2) in which the holder 100 and the support member 150 are assembled with each other. Consequently, as shown in FIG. 18, the punch cuttings can be collected from the interior 20*a* of the blade 20 into the groove 19 in the support member 150 during punching and, as shown in FIG. 19, when the holder 100 is disengaged from the support member 150, the opening 19*a* can be quickly (automatically) shielded by the elasticity of the leaf spring 161 to hold the punch cuttings remaining in the groove 19 in the support member 150 without scattering them through the opening 19*a* to the exterior, thus keeping the work environment in good condition.

The punch-cuttings drop prevention device may include an elastic member other than the leaf spring as a component. For example, an operating section is configured to slide back and forth between an operating position and a withdrawn position with a spiral spring (not shown). The operating section may be slid backward by the holder mounting operation to open the opening and, when the holder is disengaged from the support member, the operating section may automatically be slid forward from the withdrawn position to the operating position to shield the opening by the elasticity of the spring.

The present invention is a holder for mounting a blade to a perforator, which is configured as described above. Therefore, according to a first aspect of the present invention, there is provided a holder capable of mounting a blade to a perforator smoothly using a two-position switching member.

According to the present invention, there is provided a holder capable of being detachably mounted to the perforator more smoothly as compared with that by the conventional screw-type coupling method and retaining the blade in position such that it does not swing during operation in addition to the benefits from the above invention.

According to the present invention, there is provided a holder capable of applying elasticity to mounting operation to stably perform mounting/demounting operations by sandwiching the elastic compression member between it and the mounting member in contact therewith in addition to the benefits from the above invention.

According to the present invention, there is provided a holder capable of memorizing the operating position of the two-position switching member during mounting/demounting operations in addition to the benefits from the above invention.

According to the present invention, there is provided a holder capable of smoothly and easily selecting the engaged state by rotating operation in addition to the benefits from the above invention.

According to the present invention, there is provided a holder capable of fitting the engaging section of the two-position switching member into the groove in the support member, thereby being positioned stably in the support member without swing during operation in addition to the benefits from the above invention.

According to a second aspect of the present invention, there is provided a support member capable of making no punch cuttings caught therein particularly when the substantially cylindrical blade that releases the punch cuttings from below to above is mounted or demounted.

According to the present invention, the punch cuttings can be collected from the interior of the blade into the groove in the support member during punching and, when the holder is disengaged from the support member, the punch cuttings remaining in the groove in the support member can be prevented from dropping through the opening to the exterior, thus the work environment can be kept in good condition, in addition to the benefits from the above invention.

What is claimed is:

1. A holder for mounting a blade to a perforator, comprising:

a mounting member having a first mount face with a retaining section and a second mount face with a retaining section;

a two-position switching member including a hook section, an elastic compression member and an operating section; and a blade that passes through the retaining section of the first mount face, the hook section passing through the retaining section of the second mount face, and the hook section being assembled with the operating section with the elastic compression member placed between the second mount face and the operating section.

2. The holder according to claim 1, wherein the holder is detachably mounted to the perforator along the external shape of the mounting member and is retained in the assembled position with the two-position switching member.

3. The holder according to claim 1, wherein the two-position switching member can freely be switched rotatably.

4. The holder according to claim 1, wherein the two-position switching member includes an engaging section for fitting into a groove in a support member in the perforator to bring the holder into engagement with the support member of the perforator.

5. A support member to which a holder having a blade is mounted, the holder being accommodated in a perforator, wherein the holder has the characteristics claimed in claim 1;

the blade has a substantially cylindrical shape and releases punch cuttings upward therethrough; and the support member includes a first groove for positioning the blade and a second groove for releasing the punch cuttings above the first groove.

6. The support member according to claim 5, wherein the support member comprises therein a groove into which the punch cuttings are collected, an opening formed at the groove for communicating with the interior of the blade, and a punch-cuttings drop prevention device for shielding the opening.

* * * * *